US005709345A

United States Patent [19]

Yamamoto et al.

[11] Patent Number: 5,709,345

[45] Date of Patent: Jan. 20, 1998

[54] FINE POWDER HEAT TREATING APPARATUS

[75] Inventors: Takahiro Yamamoto; Masahiko Takami; Hiroshi Seno; Masami Yabuuchi; Miyuki Hirase; Yoshitsugu Yamada; Masayoshi Katsube, all of Nagaokakyo, Japan

[73] Assignee: Murata Manufacturing Co., Ltd., Kyoto, Japan

[21] Appl. No.: 632,709

[22] Filed: Apr. 15, 1996

Related U.S. Application Data

[63] Continuation of Ser. No. 172,480, Dec. 21, 1993, abandoned.

[30] Foreign Application Priority Data

| | | | |
|---|---|---|---|
| Dec. 22, 1992 | [JP] | Japan | 4-342167 |
| Oct. 5, 1993 | [JP] | Japan | 5-249321 |
| Oct. 13, 1993 | [JP] | Japan | 5-255732 |
| Nov. 2, 1993 | [JP] | Japan | 5-274313 |

[51] Int. Cl.[6] ..... B02C 17/00

[52] U.S. Cl. ..... 241/17; 241/21; 241/23; 241/65; 241/171; 241/176

[58] Field of Search ..... 241/21, 23, 171, 241/176, 177, 180, 65, 17

[56] References Cited

U.S. PATENT DOCUMENTS

| | | | |
|---|---|---|---|
| 2,540,358 | 2/1951 | Symons | 241/177 |
| 3,773,268 | 11/1973 | Bond | 241/184 X |
| 4,304,362 | 12/1981 | Buhler | 241/67 |
| 4,482,096 | 11/1984 | Lin | 241/65 |
| 4,504,020 | 3/1985 | Nishida et al. | 241/121 |
| 4,936,513 | 6/1990 | Smith | 241/24 |
| 5,065,946 | 11/1991 | Nishida et al. | 241/16 |
| 5,193,574 | 3/1993 | Pujol | 241/65 |

FOREIGN PATENT DOCUMENTS

| | | | |
|---|---|---|---|
| 356640 | 5/1991 | Japan . | |
| 0939075 | 7/1982 | U.S.S.R. | 241/176 |

*Primary Examiner*—John M. Husar

*Attorney, Agent, or Firm*—Ostrolenk, Faber, Gerb & Soffen, LLP

[57] ABSTRACT

A fine powder heat treating apparatus which includes a container rotated by an electric motor, a quantity of rolling media disposed in the container and a heater provided for heating the container and the rolling media, wherein the rolling media are mixed with each other as the container is rotated and a finely powdered raw material in a fluid state containing fine powder and a liquid component is supplied from a raw material discharge pipe.

19 Claims, 6 Drawing Sheets

FINE POWDER HEAT TREATING APPARATUS

This is a continuation of application Ser. No. 08/172,480, filed on Dec. 21, 1993, now abandoned.

BACKGROUND OF THE INVENTION

1. Field of the Invention

The present invention relates to an apparatus for subjecting a finely powdered raw material in a fluid state to a heat treatment operation, and more particularly, to a fine powder heat treating apparatus used for obtaining a ceramic material in fine powder form from a ceramic slurry, for example.

2. Description of the Prior Art

Various apparatuses for subjecting a finely powdered raw material in a fluid state obtained by mixing a solution such as water or an organic solvent with a finely powdered raw material to a heat treatment operation such as drying or calcination have been conventionally known. Examples are various apparatuses for subjecting a ceramic slurry which is a mixture of ceramic powder and water or an organic solvent to a heat treatment operation such as drying or calcination by applying heat.

Examples of heat treating apparatuses for drying or calcination of a ceramic slurry conventionally used include a batch type heating furnace, a pusher type tunnel furnace and a rotary kiln.

In a method using the batch-type heating furnace, a ceramic slurry is injected into a box container made of ceramics or a refractory metal. In addition, the container in which the ceramic slurry is injected is disposed in the heating furnace and is heated at a predetermined temperature for a predetermined time period to dry and/or calcine the ceramic slurry, to obtain a heat-treated ceramic material in a solid state.

Furthermore, in a method using the pusher type tunnel furnace, a container in which a ceramic slurry is injected is conveyed from the inlet side to the outlet side. During this conveyance, the ceramic slurry is heated and cooled, to obtain a ceramic material in a solid state.

Additionally, in a method using the rotary kiln, a cylindrical furnace core tube made of ceramics or a refractory metal is rotated in a state where it is heated to a predetermined temperature. A ceramic slurry is supplied from the inlet side of the furnace core tube, the ceramic slurry is heated in the furnace core tube, and the heat-treated ceramic slurry in a solid state is discharged from the outlet side of the furnace core tube.

The heat-treated ceramic material obtained in the above described manner is ground by a ball mill or a crusher, to be used for the sintering process, for example.

If the ceramic raw material is dried and calcined, however, an aggregate having holes formed therein is liable to be formed. Consequently, it is difficult to grind the ceramic raw material into fine powder having such a diameter so that no holes exist by the later grinding process. As a result, even if the ceramic raw material is ground, it is very difficult to obtain a dried and calcined ceramic material having no holes. If the sintering process is carried out using a ceramic material having holes, the holes reasonably remain in grains and grain boundaries of the sintered body obtained. Consequently, it is difficult to obtain a precise sintered body.

Furthermore, the ceramic material in which holes remain is inferior in the coefficient of heat conductivity. In order to obtain a precise sintered body using such a ceramic material, the sintering temperature must be increased. As a result, the sintering cost is high, and the characteristics vary. Further, in order to make the number of holes causing various problems as small as possible, a long time is required for the grinding process. However if it takes a long time for the grinding process, the sintering cost is further increased. In addition, impurities are liable to result during the grinding process.

SUMMARY OF THE INVENTION

An object of the present invention is to provide a fine powder heat treating apparatus capable of restraining aggregation of a finely powdered raw material at the time of a heat treatment and to solve the above described problems caused by the aggregation.

In a broad aspect of the present invention, there is provided an apparatus for subjecting a finely powdered raw material in a fluid state containing fine powder and water or a solvent to a heat treatment operation. The apparatus comprises a quantity of rolling media which are mixed with each other, a container containing the rolling media, heating means for heating the rolling media and the container, and raw material supplying means for supplying the finely powdered raw material in a fluid state to the heated rolling media or into the container which is heated.

In the above described fine powder heat treating apparatus, the finely powdered raw material in a fluid state is supplied to the heated rolling media into the container which is heated. A liguid component such as water contained in the finely powdered raw material in a fluid state evaporates due to contact with the rolling media or the container. As a result, only fine powder components in the finely powdered raw material adhere to the surfaces of the rolling media or the surface of the container and remain thereon. In addition, the rolling media are mixed with each other. Accordingly, the fine powder components remaining on the surfaces of the rolling media or the surface of the container are ground by a collision between with the rolling media or a collision between the rolling media and the container. As a result, the liquid component is removed, and the finely ground fine powder components are formed. The fine powder components become gradually light in weight, rising upward along the inner wall of the container.

The newly supplied finely powdered raw material is heavier in weight than the heat-treated finely powdered raw material because it contains a liquid component. Consequently, the newly supplied finely powdered raw material which is in a fluid state sinks to a lower part of the container, and comes into contact with the rolling media or the like, so that the above described operation is repeated.

Since the aggregation is restrained even though the finely powdered raw material is subjected to a heat treatment operation, it is possible to obtain a finely powdered material without secondary particles which aggregate and including primary particles which do not aggregate. As a result, the finely powdered material thus obtained is used to make it possible to manufacture products having a density close to a solid and to stabilize the variation in characteristics and the quality in the final products.

Furthermore, in accordance with a particular aspect of the present invention, the above described container is constituted by a truncated cone or truncated pyramid drum body for heating which is disposed sideways and is rotated around its axis, and the above described rolling media are disposed in the truncated cone or truncated pyramid drum body for heating. A portion, excluding a finely powdered raw material supply portion, on the side of the large diameter end of the truncated cone or truncated pyramid drum body for heating is closed.

In the above described construction, the drum body for heating which is heated is rotated, so that the rolling media contained therein roll in a state where they abut against each other, toward the large diameter end of the drum body. If in this state, the finely powdered raw material in a fluid state is supplied to the drum body from the raw material supply portion provided on the side of the large diameter end of the drum body, the liquid component such as water contained in the raw material, is evaporated by the contact with the rolling media or the inner wall of the drum body. As a result, only the fine powder components in the raw material adhere to the surfaces of the rolling media or the surface of the inner wall of the drum body and remain thereon. Further, the rolling media are mixed with each other. Therefore, the fine powder components remaining on the surfaces of the rolling media are canceled by a collision between the rolling media and a collision between the rolling media and the inner wall of the drum body. As a result, the finely powdered raw material which is deprived of the liquid component is finely ground to gradually become light in weight. Consequently, the finely powdered raw material which is heated and ground, as described above, rises upward along the inner peripheral surface of the drum body. The heat-treated finely powdered raw material which is moved to the upper end of the drum body is discharged from the above described small diameter end.

Furthermore, in accordance with a more particular aspect of the present invention, a drum body for cooling is connected to the small diameter end of the above described drum body. In this case, the heat-treated finely powdered raw material which is discharged from the small diameter end is gradually cooled within the drum body for cooling.

In accordance with another broad aspect of the present invention, there is provided a method of heat-treating fine powder. A finely powdered raw material in a fluid state containing fine powder and a liguid component such as water or a solvent is subjected to a heat treatment operation, comprising the step of supplying the finely powdered raw material in a fluid state little by little to rolling media heated while being mixed or to a container which contains the rolling media and heated.

According to the above described method of heat-treating fine powder, the liquid component contained in the finely powdered raw material and supplied to the rolling media heated or the container heated is evaporated by the contact with the rolling media or the container. Consequently, only the fine powder components in the finely powdered raw material adhere to the surfaces of the rolling media and the surface of the inner wall of the container and remain thereon. Further, the rolling media are mixed with each other. Therefore, the fine powder components adhering to the surfaces of the rolling media and the remaining fine powder components are ground by a collision between the rolling media and a collision between the rolling media and the inner wall of the container. As a result, the finely powdered raw material, which is deprived of the liquid component, is finely ground to gradually become light in weight. Consequently, the heat-treated finely powdered raw material rises upward along the inner wall of the container.

In the above described method according to the present invention, therefore, it is possible to obtain a finely powdered material which is not secondary particles which aggregate but primary particles which do not aggregate irrespective of the fact that the finely powdered raw material in a fluid state is subjected to the above described heat treatment operation. Accordingly, it is possible to increase the density of the final product by using the fine powder to a density close to a solid density and to improve the characteristics and stabilize the quality in the final product.

Although the fine powder heat treating apparatus according to the present invention is used for obtaining a finely powdered material from various finely powdered raw materials in a fluid state, it is preferably used in drying and/or calcining a ceramic slurry containing ceramic powder and a liquid component.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

Figure 1:
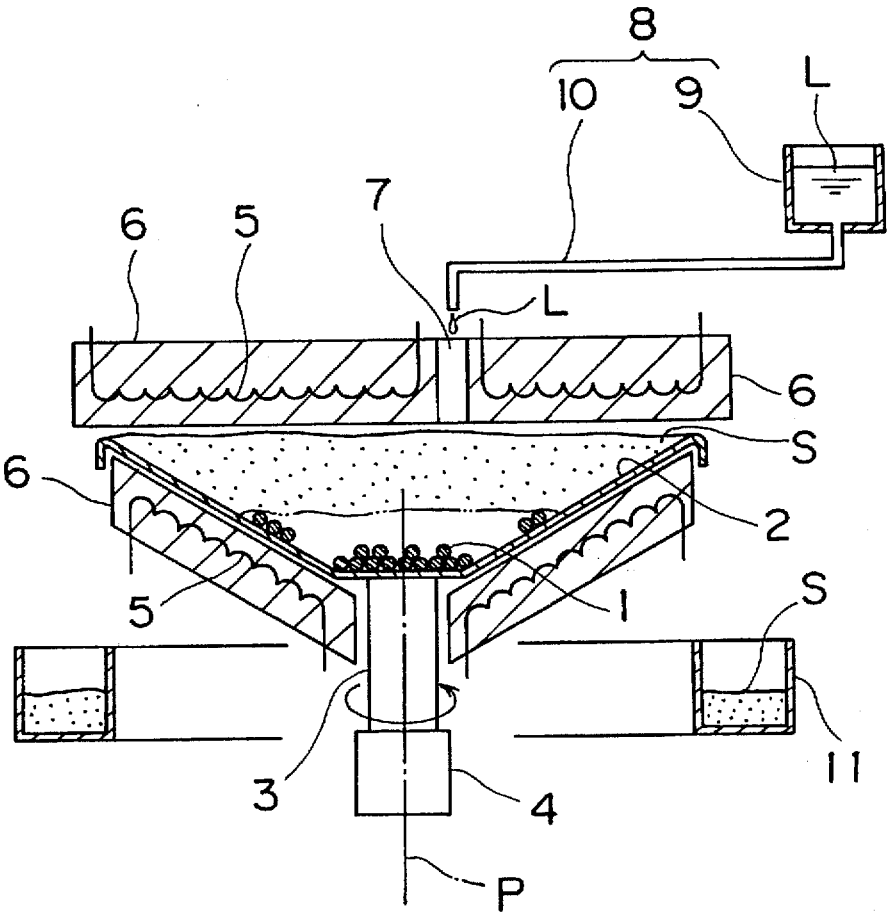
FIG. 1 is a cross sectional view schematically showing a fine powder heat treating apparatus according to a first embodiment of the present invention.

FIG. 1 is a cross sectional view showing a fine powder heat treating apparatus according to a first embodiment of the present invention.

An apparatus for and a method of fabricating fine powder according to the present embodiment for use with a ceramic slurry obtained by mixing a liquid component such as water or an organic solvent with ceramic powder as a finely powdered raw material in a fluid state. Specifically, the present embodiment is used for obtaining a finely powdered ceramic material in a solid state by subjecting the ceramic slurry to a heat treatment operation such as drying and calcination. The fabricating method comprises supplying the ceramic slurry, little by little, or slowly, to rolling media which is heated while being mixed or a container containing the rolling media and heated.

Referring to FIG. 1, in the fine powder heat treating apparatus according to the present embodiment, a lot of rolling media 1 referred to as media are used. The rolling media 1 are contained in a container 2. The container 2 is so constructed as to be rotated around an axis P. In addition, the container 2 has a shape opened upward and is so disposed that the axis is directed toward the vertical. The container 2 is supported by a supporting shaft 3 in its lower part. An electric motor 4 which can be rotated at constant speed is connected to a lower end of the supporting shaft 3.

The above described rolling media 1 are made of ceramics and a refractory metal, and can be fabricated in the shape of a sphere having a diameter of approximately 1 to 50 mm and in the shape of a cylinder of approximately the same size.

The material, size and the shape of the rolling media 1 are selected in consideration of the internal volume and the shape of the container 2 or the properties of ceramic powder. In addition, the container 2 is made of ceramics or a refractory metal in a thin plate shape, and is constructed in the shape of a truncated cone opened upward as described above.

Furthermore, the fabricating apparatus comprises electric heaters 5 serving as heating means for heating the rolling media 1 and the container 2 and heat insulating members 6 having a predetermined thickness respectively containing the electric heaters 5. Each of the heat insulating members 6 is so disposed as to surround a side surface and an opened surface of the container 2 with a clearance of predetermined size interposed therebetween. The heat insulating member 6 disposed in a position opposed to the opened surface of the container 2 is provided with a hole 7 passing through the heat insulating member 6 in the direction of thickness in a predetermined portion shifted from the vertical axis P.

Additionally, the fabricating apparatus comprises raw material supplying means 8 for dropping a ceramic slurry L which is a finely powdered raw material in a fluid state on the rolling media 1 heated or the container 2 heated by the electric heaters 5 and supplying the same. The raw material supplying means 8 comprises a slurry storage container 9 storing a prepared ceramic slurry L and a slurry pipe 10 connected thereto. A discharge port in an end of the slurry pipe 10 is arranged in a position facing the through hole 7 formed in the heat insulating member 6 covering the opened surface of the container 2. It is desirable that a valve for controlling the amount of supply of the ceramic slurry L is provided in, for example, an intermediate position of the slurry pipe 10. Reference numeral 11 in the figure denotes a recovery container for containing a heat-treated ceramic material S in a solid state. The recovery container 11 in an annular box shape as viewed from the top is disposed in a position lower than an outer peripheral edge of the container 2 to which the ceramic slurry L is supplied.

Description is now made of the procedure in obtaining a ceramic material S from a ceramic slurry L by performing a heat treatment operation using the fabricating apparatus according to the present embodiment.

A prepared ceramic slurry L obtained by mixing a solution such as water or an organic solvent with ceramic components is first prepared. On the other hand, the electric heater 5 is used while the container 2 containing the rolling media 1 is rotated by the electric motor 4, thereby to heat the rolling media 1 and the container 2 to a predetermined temperature. The rolling media 1 and the container 2 are heated to approximately 500° C. in drying the ceramic slurry L, while being heated to approximately 1000° C. in calcining the same. The ceramic slurry L stored in the slurry storage container 9 constituting the raw material supplying means 8 is dispensed little by little from the slurry pipe 10 and is dropped on the rolling media 1 previously heated and supplied thereto after passing through the through hole 7 in the heat insulating member 6 disposed on the upper side. The ceramic slurry L may also be dropped on the container 2.

Consequently, the solution such as water contained in the ceramic slurry L supplied by the dropping is evaporated by the contact with the rolling media 1 or the like. As a result, only the ceramic components in the ceramic slurry L adhere to the surfaces of the rolling media 1 or the like and remain thereon. Since the rolling media 1 are mixed with each other by the rotation of the container 2, however, the rolling media 1 are rubbed together while colliding with each other, so that the ceramic components remaining in a state where they spread on the respective surfaces of the rolling media 1 are ground. The finely ground ceramic slurry L, after being deprived of the solution, gradually becomes light in weight, and rises upward along the wall surface of the container 2. In this case, newly dropped ceramic slurry L is heavy in weight because it contains a solution, and sinks into a lower part of the container 2. The ceramic slurry L is then ground by the rolling media 1 after the solution contained therein is evaporated by the contact with the rolling media 1 or the like, which operations are repeated.

As a result, the heat-treated ceramic material S in a solid state is gradually stored in an upper part of the container 2 rotated after containing the rolling media 1. The ceramic material S stored is discharged by the function of a centrifugal force from a clearance provided between the opened surface of the container 2 and the heat insulating member 6 disposed on the upper side. The discharged ceramic material S is recovered by the recovery container 11 disposed in the position corresponding to and below the outer peripheral edge of the container 2 and then, is sent to the sintering process.

Although in the present embodiment, the finely powdered raw material in a fluid state is the ceramic slurry L and the finely powdered material in a solid state is the ceramic material S, the fine powder is not limited to ceramics. In addition, existing equipment such as a ball mill, a rod mill or a lateral conical pot may be applied as the container 2 containing the rolling media 1 and rotated and heated. Furthermore, although in the present embodiment, the rolling media 1 are mixed with each other by the rotation of the container 2, an agitating member (not shown) other than the container 2 can be provided and used to mix the rolling media 1 contained in the container 2 fixed and supported with each other.

Second Embodiment

Figure 2:
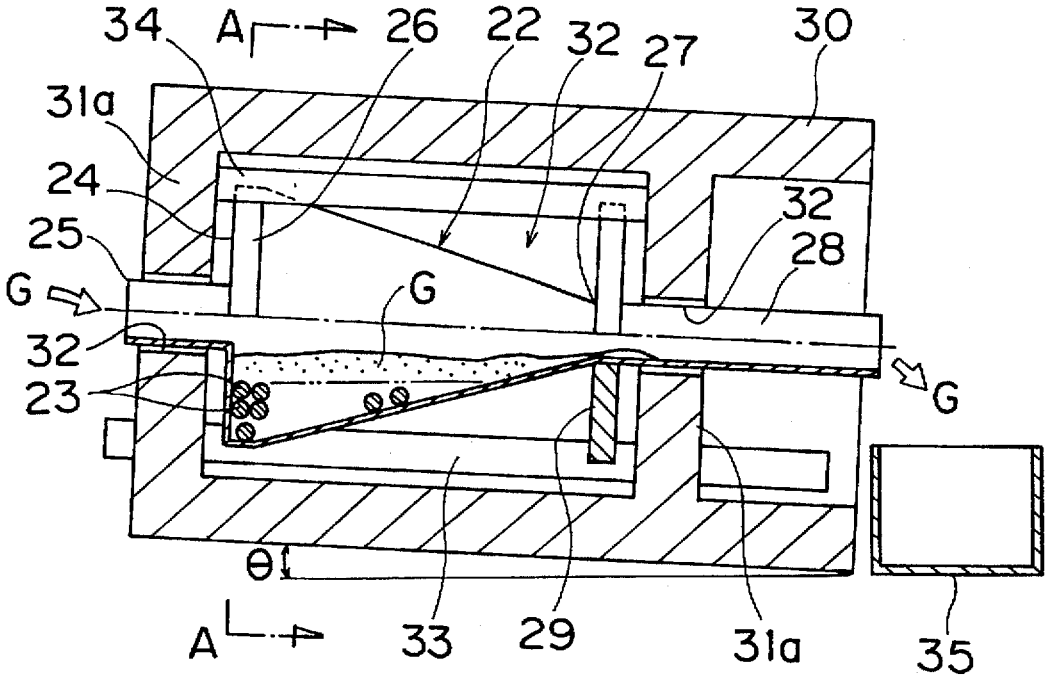
FIG. 2 is a cross sectional view showing the construction of a ceramic raw material heat treating apparatus according to a second embodiment of the present invention.
Figure 3:
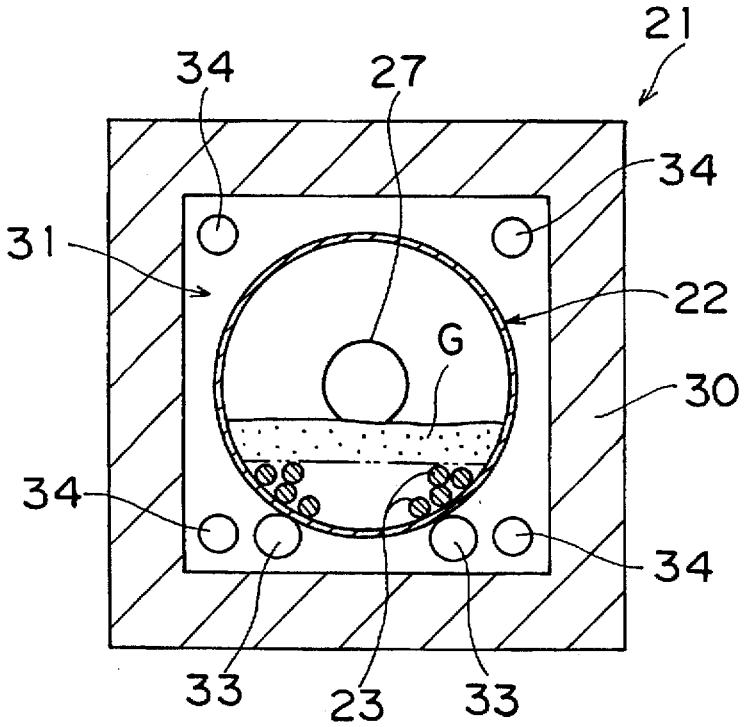
FIG. 3 is a cross sectional view taken along a line A—A shown in FIG. 2.

FIG. 2 is a cross sectional view showing a ceramic raw material heat treating apparatus according to one embodiment of the present invention, and FIG. 3 is a cross sectional view taken along a line A—A shown in FIG. 2. A ceramic raw material heat treating apparatus 21 comprises a truncated cone drum body for heating 22 for drying and calcining a ceramic raw material G and disposed sideways and heat resisting rolling media 23. The truncated cone drum body for heating 22 is made of alumina, quartz or a refractory metal. A large diameter end 24 on the left side of FIG. 2 is closed, and a cylindrical ceramic raw material supply pipe 25 is connected to an end surface of the drum body 22 on the side of the large diameter end 24. In addition, a short cylinder portion 26 is formed in an end of the large diameter end 24. In the end, adjacent to the small diameter end 27 on the right side of FIG. 2, a cylindrical drum body for cooling 28 having the same inner diameter as that of the small diameter end 27 is provided to. cylindrical drum body for cooling 28 and the above described ceramic raw material supply pipe 25 are disposed in the axial direction of the truncated cone drum body for heating 22. A disk-shaped collar portion 29 is mounted on the outer periphery of the small diameter end 27. The outer shape of the collar portion 29 has the same diameter as the outer diameter of the cylinder portion 26 in the large diameter end 24.

The heat resisting rolling media 23 are made of the same material as that of the drum body 22, that is, alumina, quartz or a refractory metal. A plurality of heat resisting rolling media are contained in the drum body 22. In the present embodiment, the entire length of the truncated cone drum body for heating 22 is approximately 300 mm, the inner diameter of the cylinder portion 26 is 200 mm, and the inner diameter of the small diameter end 27 is 90 mm. A heat resisting rolling medium 23 having a diameter of approximately 20 to 30 mm is used as the most suitable product for the drum body 22 of such size. Furthermore, the heat resisting rolling medium 23 is not limited to one in a spherical shape. For example, it may be one in a cylindrical shape.

The drum body 22 thus constructed is disposed in a housing 30 made of a heat insulating material. A heating chamber 31 is formed in the housing 30, and through holes 32 are respectively formed in left and right wall portions 31*a* in the heating chamber 31. Further, a pair of rotating shafts 33 is disposed in parallel in a lower end of the heating chamber 31, and spiral heaters 34 are disposed in four corners of the heating chamber 31. A variable rotating mechanism (not shown) is connected to ends of the rotating shafts 33.

The drum body 22 is rotatably contained in the heating chamber 31 and the cylindrical drum body for cooling 28 is disposed outside the heating chamber 31 in a state where the ceramic raw material supply pipe 25 and the cylindrical drum body for cooling 28 are respectively inserted through the through holes 32 and the cylinder portion 26 and the collar portion 29 respectively abut against the rotating shafts 33. The housing 30 containing the drum body 22 is fixed to a base (not shown). In the case, the housing 30 is mounted in a state where it is raised at a very small angle on the side of the large diameter end 24.

Description is now made of the processes of drying and calcining the ceramic raw material G by the ceramic raw material heat treating apparatus 21 of the above described construction. First, the inside of the truncated cone drum body for heating 22 is heated to a temperature of 400° to 1200° C. by the spiral heaters 34, and is rotated at a speed of 0.2 to 4 rpm by rotating the rotating shafts 33 by the variable rotating mechanism. The rotation of the rotating shafts 33 is transmitted to the drum body 22 through the cylinder portion 26 and the collar portion 29.

In this state, the ceramic raw material G in the shape of a slurry is dropped into the drum body 22 from an outer end of the ceramic raw material supply pipe 25. The rotation of the drum body 22 and the heating of the spiral heaters 34 are continued while dropping the ceramic raw material G. At this time, the heat resisting rolling media 23 roll in a state where they abut against each other toward the large diameter end. If the ceramic raw material G is dropped into the drum body 22, a solution such as water contained in the ceramic raw material G is evaporated by the contact with the heat resisting rolling media 23 or the like. Accordingly, only the ceramic components in the ceramic raw material G adhere to the surfaces of the heat resisting rolling media 23 and remain thereon. Since the heat resisting rolling media 23 are mixed with each other, the ceramic components remaining on, for example, the surfaces of the heat resisting rolling media 23 are ground as the heat resisting rolling media 23 are rubbed together while colliding with each other. As a result, the ceramic raw material 3 which is finely ground after being deprived of the solution gradually becomes light in weight, to rise upward along the slope of the drum body 22. The dried and calcined ceramic raw material G moved to an upper end of the whole of the supplied ceramic raw material G overflows from the small diameter end into the cylindrical drum body for cooling 28.

The ceramic raw material G moved to the cylindrical drum body for cooling 28 is gradually cooled in the cylindrical drum body for cooling 28 because the cylindrical drum body for cooling 28 is disposed outside the heating chamber 31. The ceramic raw material G which has been cooled is dropped outward from the outside of the cylindrical drum body for cooling 28, to be contained in a containing box 35 disposed below an outer end of the cylindrical drum body for cooling 28.

In the present embodiment, the housing 30 is inclined at a very small angle θ, and the heat-treated ceramic material G moved to the cylindrical drum body for cooling 28 is smoothly moved in the cylindrical drum body for cooling 28 toward the outer end thereof.

The ceramic raw material G thus heat-treated is simultaneously ground by the heat resisting rolling media 23 during heat treatment processing. The ceramic raw material G gradually rises toward the small diameter end 27 which is a takeoff as the grinding thereof progresses, as described above. Therefore, such so-called short-path hardly occurs that the ceramic raw material G while being ground suddenly reaches the small diameter end 27 after jumping the grinding process. Consequently, the ground ceramic raw material G having uniform particles is obtained, and the diameter of the finely ground particles can be accurately controlled by adjusting the number of revolutions of the drum body 22.

Furthermore, the heat-treated ceramic raw material G is gradually cooled by the cylindrical drum body for cooling 28, thereby to eliminate the problem that the ceramic raw material G is suddenly taken out of the truncated cone drum body for heating 22 and rapidly cooled, resulting in degraded properties thereof.

Furthermore, if the ceramic raw material G must be heated in a predetermined atmosphere, necessary atmospheric gas may be supplied after the outer ends of the ceramic raw material supply pipe 25 and the cylindrical drum body for cooling 28 are closed to seal the truncated cone drum body for heating 22 except in a case where the ceramic raw material is injected and a case where the heat-treated ceramic raw material is taken out.

Although in the above described embodiment, the spiral heaters 34 provided separately from the truncated cone drum body for heating 22 are used as heaters for heating the drum body 22 and are disposed in the heating chamber 31, the heaters may be directly affixed to the outside of the drum body 22 so as to efficiently heat the drum body 22.

Furthermore, although in the above described embodiment, the truncated cone drum body for heating 22 is internally driven, that is, rotated by the rotating shafts 33 pulled into the heating chamber 31, the truncated cone drum body for heating 22 may be externally driven, that is, rotated by a rotating portion disposed outside the heating chamber 31 from the ceramic raw material supply pipe 25 to the cylindrical drum body for cooling 28. If the truncated cone drum body for heating 22 is externally driven, almost all of parts constituting the rotating portion can be disposed in an ordinary temperature state, thereby eliminating the necessity of producing the parts in heat resistant construction.

Figure 4:
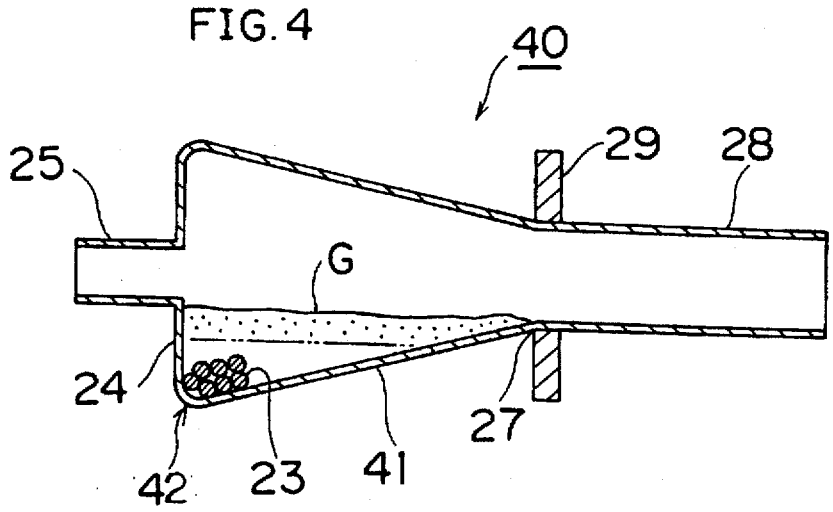
FIG. 4 is a cross sectional view for explaining a modified example of a truncated cone drum body for heating.

Additionally, the truncated cone drum body for heating 22 may be constructed as shown in FIG. 4. The truncated cone drum body for heating 40 is characterized by a corner portion 42 formed between a peripheral surface 41 and a large diameter end 24. Specifically, the corner portion 42 is a curved surface having a radius of curvature larger than the radius of each of the heat resisting rolling media 23. By thus constructing the corner portion 42, the heat resisting rolling media 23 can enter the corner portion 42 until they abut against the inner surface of the corner portion 42. Therefore, a ceramic raw material G entering the corner portion 42 during heat treatment is reliably taken out of the corner portion 42 by the rolling of the heat resisting rolling media 23, thereby eliminating the possibility that the ceramic raw material G entering the corner portion 42 stays in the corner portion 42 to adhere to the inner surface of the corner portion 42. Such adhesion of the ceramic raw material G not only requires periodic cleaning work but also prevents continuous heat treatment. If the corner portion 42 is thus formed, therefore, maintenance is simplified, and continuous unmanned driving becomes possible over a long time period.

Figure 5:
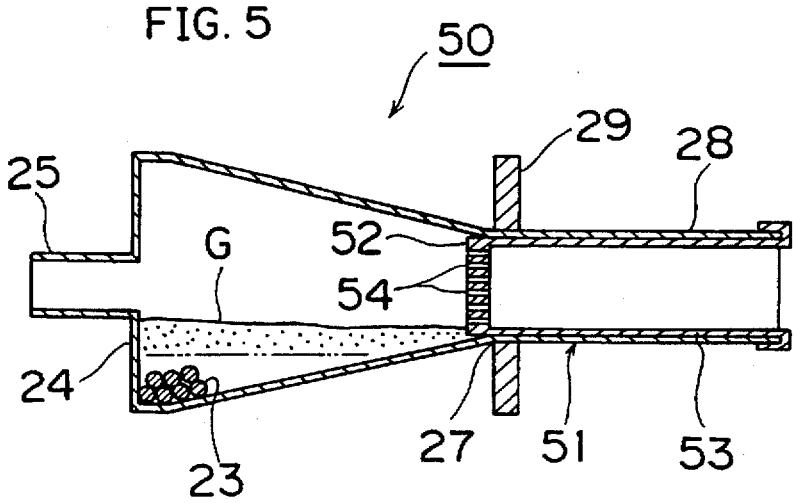
FIG. 5 is a cross sectional view for explaining another modified example of a truncated cone drum body for heating.

Furthermore, the truncated cone drum body for heating may be constructed as shown in FIG. 5. The truncated cone drum body for heating 50 comprises a member for preventing rolling media from being jumped out 51. The member for preventing rolling media from jumping out 51 comprises an annular sealing member 52 of such size as to close a small diameter end 27 and a supporting member 53 for supporting the annular sealing member 52 in the drum body 50. The annular sealing member 52 is provided with a plurality of slits 54. The slit 54 has a width through which each of the heat resisting rolling media 23 cannot pass. One end of the supporting member 53 is connected to the annular sealing member 52, and the other end thereof is engaged with an end of an opening of a cylindrical drum body for cooling 28. The supporting member 53 is thus constructed to support the annular sealing member 52.

Even if the number of heat resisting rolling media 23 is increased so as to enhance the agitating and grinding effect, the problem that the heat resisting rolling media 23 jumped out to the cylindrical drum body for cooling 28 from a small diameter end 27 is eliminated by providing the drum body 50 with the member for preventing rolling media from jumping out 51.

Figure 6:
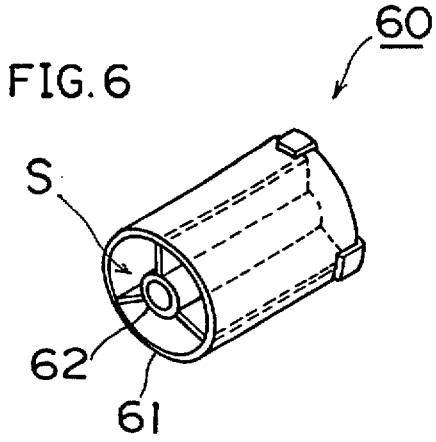
FIG. 6 is a cross sectional view for explaining a modified example of a member for preventing rolling media from being jumped out.

The member for preventing rolling media from jumping out may be not only one shown in FIG. 5 but also a member for preventing rolling media from being jumped out 60 shown in FIG. 6. The member for preventing rolling media from jumping out 60 is so constructed that a plurality of cylinder bodies 61 and 62 are coaxially disposed and fixed to each other, and a clearance S between the cylinder bodies 61 and 62 is made smaller than the diameter of each of the heat resisting rolling media 23. Thus, the member for preventing rolling media from jumping out may be one having an opening through which the ceramic raw material G can pass but each of the heat resisting media 23 cannot pass.

Figure 7:
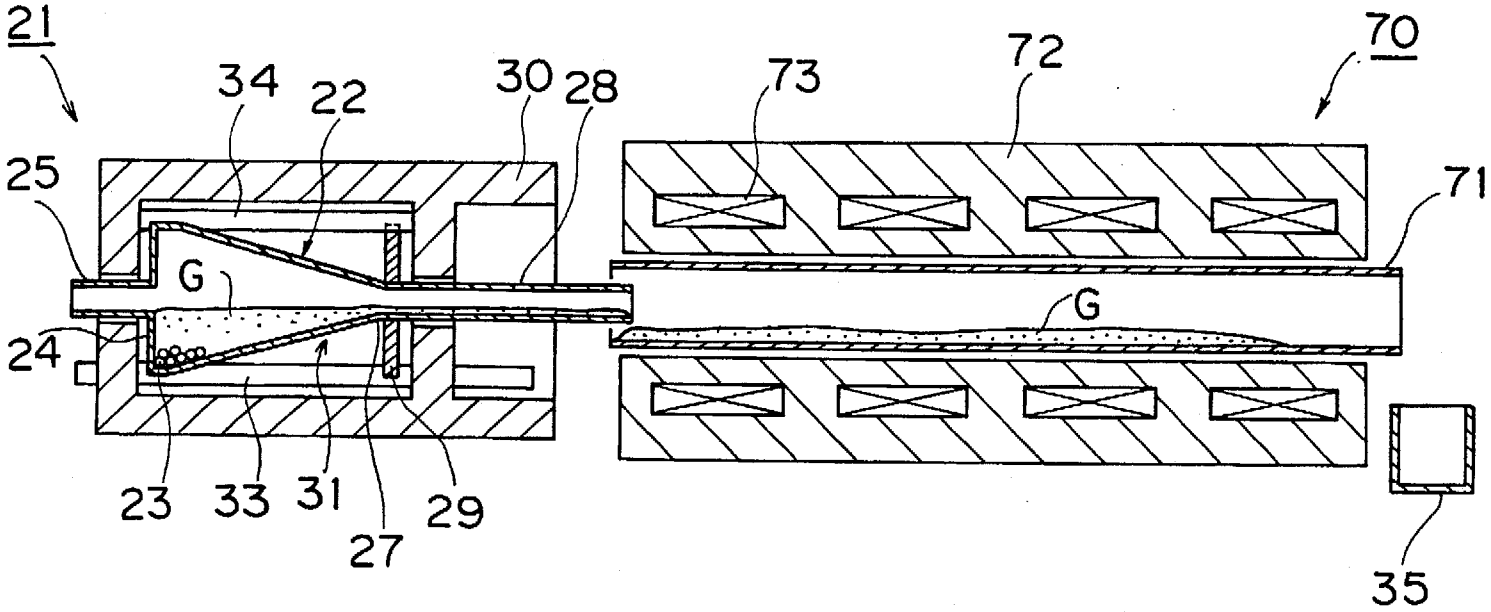
FIG. 7 is a cross sectional view for explaining a ceramic raw material drying and calcining apparatus constructed by combining a ceramic raw material heat treating apparatus according to a second embodiment of the present invention and an external heating type rotary kiln.

Although in the ceramic raw material heat treating apparatus 21 according to the above described embodiment, the ceramic raw material G is dried and calcined, the ceramic raw material G may be only calcined. Further, as shown in FIG. 7, the ceramic raw material heat treating apparatus 21 shown in FIGS. 2 and 3 may be connected in communication with an external heating type rotary kiln (a so-called DK furnace) 70 so that the ceramic raw material G is dried by the ceramic raw material heat treating apparatus 21 and calcined by the external heating type rotary kiln 70. In FIG. 7, reference numeral 71 denotes a furnace core tube in the external heating type rotary kiln 70, reference numeral 72 denotes a furnace casing containing the furnace core tube 71, and reference numeral 73 denotes a heater disposed in the furnace casing 72.

Third Embodiment

Figure 8:
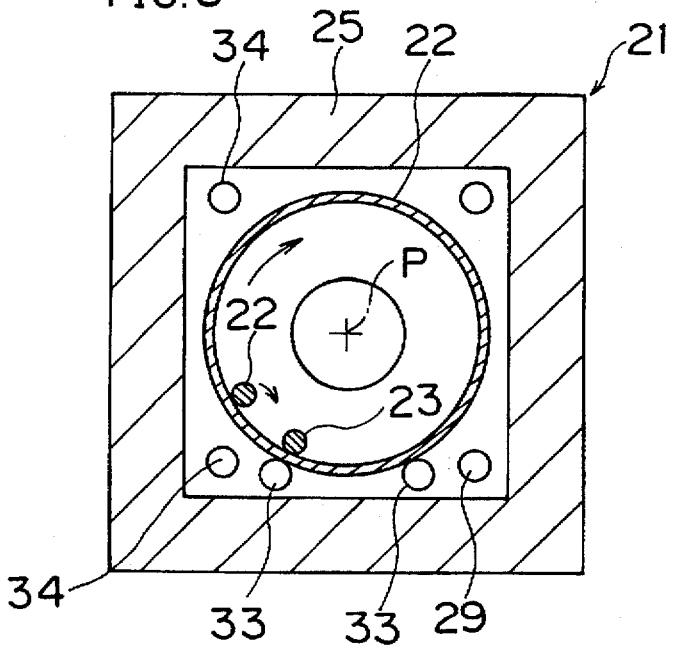
FIG. 8 is a cross sectional view for explaining a state where rotating media are moved in the heat treating apparatus shown in FIG. 3.

A heat treating apparatus according to a third embodiment of the present invention has a structure obtained by further improving the structure of the heat treating apparatus according to the second embodiment. Although in the heat treating apparatus according to the second embodiment, as shown in FIG. 8, the rolling media 23 are mixed with each other in the truncated cone drum body 22, the rolling media 23 are dropped after being raised to a certain height as the drum body 22 is rotated, which process is repeated.

Since the drum body 22 has the shape of a truncated cone, and is circular in cross section, the rolling media 23 are moved upward depending on the rotation speed of the drum body 22. In many cases, the rolling media 23 slip off along the inner surface of the drum body 22. Consequently, the rolling media 23 cannot be raised to a very high position. As a result, it is difficult to cause the position where the dropping of the rolling media 23 occurs to be a high position. Consequently, it is difficult to increase the efficiency of grinding of fine powder, i.e., ceramic powder, which is disadvantageous in obtaining a ceramic material in which no shift in composition or abnormal aggregation occurs. The third embodiment is for improving such disadvantages of the second embodiment.

Figure 9:
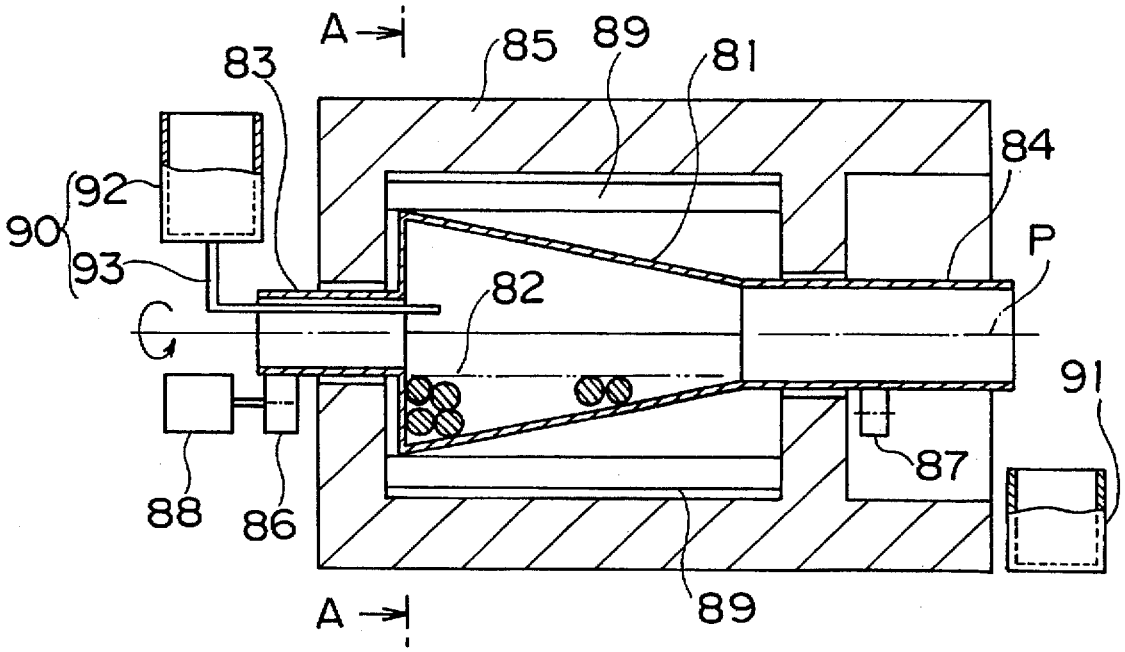
FIG. 9 is a longitudinal sectional view schematically showing the overall construction of a fine powder heat treating apparatus according to a third embodiment of the present invention.
Figure 10:
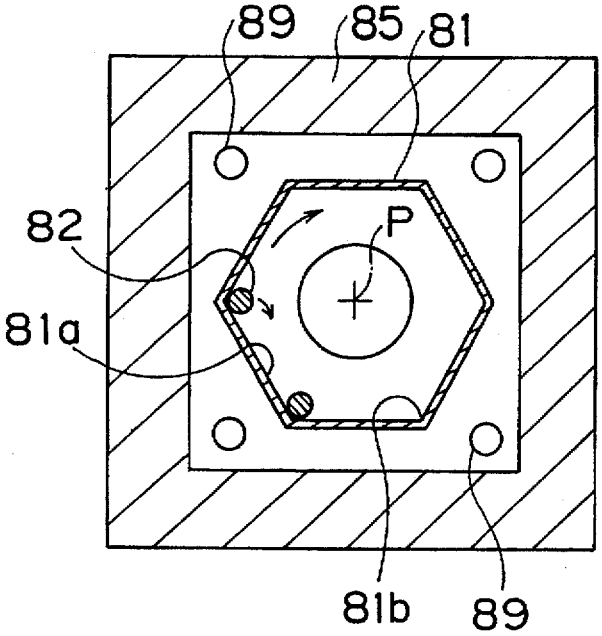
FIG. 10 is a cross sectional view taken along a line A—A shown in FIG. 9.
Figure 11:
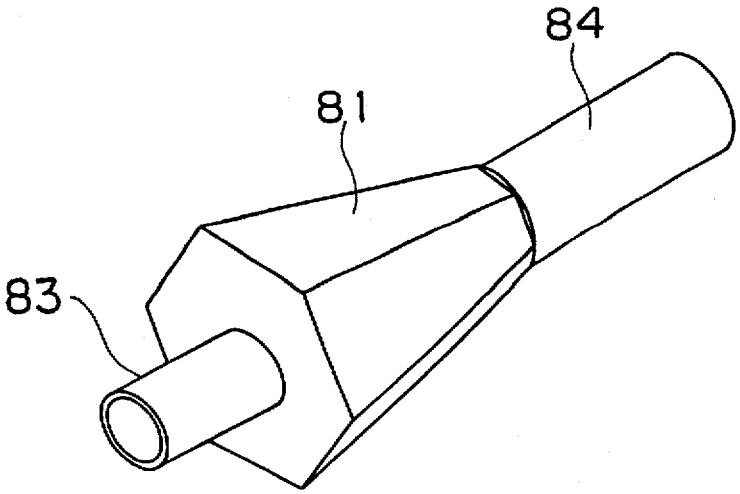
FIG. 11 is a perspective view showing the external shape of a drum body used in the third embodiment.

FIG. 9 is a longitudinal sectional view showing a heat treating apparatus according to the third embodiment, FIG. 10 is a transverse sectional view thereof, which is taken along a line A—A shown in FIG. 9, and FIG. 11 is a perspective view showing the external shape of a drum body used in the third embodiment.

The heat treating apparatus according to the present embodiment comprises a drum body 81 which is supported sideways and is rotated around an axis P and into which a ceramic raw material (not shown) is injected after being previously heated and a lot of rolling media 82 which are contained in the drum body 81 and are mixed with each other. The drum body 81 made of a plate material such as ceramics or a refractory metal has the shape of a polygonal truncated pyramid such as a quadrangular truncated pyramid or a hexagonal truncated pyramid, and each of the rolling media 82 is made of ceramics or a refractory metal and has the shape of a sphere, a cylinder and a polygonal truncated pyramid having a diameter of approximately 1 to 50 mm. Specifically, in this heat treating apparatus, the drum body 81 has, for example, the shape of a hexagonal truncated pyramid and is hexagonal in cross section, and communicating tubes 83 and 84 in a conical drum shape which are positioned on the same axis P are respectively connected to a large diameter end and a small diameter end of the truncated cone drum body 81. The drum body 81 is supported in a state where it is inclined at an angle of 1° to 3° so that the communicating tube 84 is in a position lower than the communicating tube 83.

Therefore, respective corners 81*b* which are formed where inclined surfaces 81*a* abut against each other at a predetermined angle are formed along the axis P on the inner surface of the drum body 81. Consequently, the respective rolling media 82 contained are raised as the drum body 81 is rotated while being held in a state where they hang on the respective corners 81*b* which have a grooved shape. Accordingly, the rolling media 82 are mixed with each other while being repeatedly dropped after being raised to a position where the dropping is started, which is higher than that in the second embodiment of the invention, as the truncated cone drum body 81 is rotated.

Although in the heat treating apparatus according to the present embodiment, the drum body 81 is heated by spiral heaters 89 provided in a heat insulating wall portion 85, a heat source of the drum body 81 is not limited to the spiral heaters 89. For example, an electric heater constructed using a cylinder body made of a refractory metal, i.e., a so-called radiant tube may be projected toward the inside of a tubular container along the axis P of the tubular container. Alternatively, a burner device having a structure in which a gas burner is mounted in a radiant tube or a direct fired type burner device may be used. Further, a method such as electromagnetic induction heating or induction heating may be employed.

Furthermore, the heat treating apparatus comprises raw material supplying means 90 for injecting a ceramic raw material in a fluid state into the drum body 81 and a material recovery container 91 for recovering a ceramic material which has been heat-treated (not shown). The raw material supplying means 90 is disposed above one end (on the left side in FIG. 9) of the heat insulating wall portion 85 through which the communicating tube 83 penetrates. This raw material supplying means 90 comprises a raw material storage tank 92 in which the prepared ceramic raw material is stored and a raw material supply pipe 93 pulled into the drum body 81 after passing through the communicating tube 83. The communicating tube 83 is connected to the large diameter end of the drum body 81. On the other hand, the material recovery container 91 having an upward opened surface is disposed below the other end (on the right side in FIG. 9) of the heat insulating wall portion 85 through which the communicating tube 84 penetrates. A ceramic material which is solidified into fine powder is discharged through the communicating tube 84 and stored in the material recovery container 91. The communicating tube 84 is connected to the small diameter end of the drum body 81.

Description is now made of the procedure in obtaining a finely powdered ceramic material solidified by subjecting a ceramic raw material to a heat treatment operation such as drying or calcination by using the heat treating apparatus according to the present embodiment.

First, a ceramic raw material such as soil or a slurry which is a mixture of ceramics and a solution is prepared and then, is stored in the raw material storage tank 92 in the raw material supplying means 90. The drum body 81 containing a lot of rolling media 82 is rotated at a low speed of approximately 0.2 to 10 rpm by an electric motor 88, and the spiral heaters 89 are energized, thereby to heat the drum body 81 and the rolling media 82 to a predetermined temperature. The ceramic raw material stored in the raw material storage tank 92 is dropped from an opening of the raw material supply pipe 93 pulled into the drum body 81, and is injected little by little over the drum body 81 or the rolling media 82 previously heated to a predetermined temperature.

Consequently, a solution is quickly evaporated from the ceramic raw material which is brought into contact with the rolling media 82 or the like, so that only ceramic components in the ceramic raw material adhere to the surfaces of the rolling media 82 and remain thereon. Since the rolling media 82 are mixed with each other as the drum body 81 is rotated, the ceramic components remaining on the respective surfaces of the rolling media 82 are finely ground as the rolling media 82 are rubbed together while colliding with each other. Specifically, the rolling media 82 in this case are raised as the drum body 81 is rotated in a state where they hang on the corners 81*b* in a grooved shape appearing on the inner surface of the drum body 81 in the shape of a hexagonal truncated pyramid and then, are dropped from a position where the dropping is started, which is higher than that in the second embodiment, which operations are repeated. Consequently, the distance of fall is longer than that in the second embodiment. Since the rolling media 82 collide with each other more strongly than in the second embodiment, the ceramic components remaining on the respective surfaces of the rolling media 82 are ground more finely than in the second embodiment.

The ceramic raw material finely ground after being deprived of the solution gradually becomes lighter in weight. As a result, the ceramic raw material rises above the rolling media 82 which are mixed with each other and is stored in the drum body 81 and then, is discharged as a finely powdered ceramic raw material outward from the communicating tube 84 into the material recovery container 91. Since a ceramic raw material newly supplied in this case is heavy in weight because it contains a solution, the ceramic raw material sinks below the rolling media 82. With respect to the ceramic raw material which sank, the solution is evaporated and ceramic components are ground, and the steps are repeated. Time required from the injection of the ceramic raw material to the discharge of the ceramic raw material in the drum body 81, controlled by adjusting the inclined state and the rotation speed of the drum body 81.

The shape of the above described drum body 81 is selected in consideration of properties such as adhesion and cohesiveness in the ceramic raw material which is subjected to a heat treatment operation. For example, in subjecting a ceramic raw material which is low in adhesion and high in cohesiveness to a heat treatment operation, a drum body in the shape of a quadrangular truncated pyramid is preferably used. Further, in a ceramic raw material which is liable to be dried and requires a great amount of heat treatment, a drum body having a large number of angles is effective.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A fine powder heat treating apparatus for subjecting a ceramic slurry containing fine ceramic powder and a liquid component to a heat treatment operation to obtain a fine powdered material, comprising:

a container; rolling media contained in said container;

a heater which is operable for heating said rolling media and said container to a temperature sufficient to vaporize the liquid component and to heat-treat the fine ceramic powder; and raw material supplying means for supplying the ceramic slurry to the heated container containing the rolling media.

2. The fine powder heat treating apparatus according to claim 1, wherein said container has the shape of a truncated cone opened upward, and further comprising a rotator connected to said container, for rotating said container around its axis.

3. The fine powder heat treating apparatus according to claim 1, further comprising a heat insulating member disposed on the upper surface of said container so as to cover almost the whole of the upper surface thereof, a through hole to which the ceramic slurry material is supplied being formed in the heat insulating member.

4. The fine powder heat treating apparatus according to claim 3, wherein said raw material supplying means comprises a storage container storing the ceramic slurry and a discharge pipe connected to the storage container for discharging the ceramic slurry, and an end of the discharge pipe is positioned above said through hole.

5. The fine powder heat treating apparatus according to claim 1, wherein a clearance is formed around the container between said heat insulating member and an upper end of the container.

6. The fine powder heat treating apparatus according to claim 1, wherein each of said rolling media is spherical in shape.

7. The fine powder heat treating apparatus according to claim 6, wherein said rolling media are made of a material selected from the group consisting of ceramics and refractory materials.

8. The fine powder heat treating apparatus according to claim 1, wherein:

said container is constituted by a truncated cone or truncated pyramid drum for heating having an axis, a large diameter end, a small diameter end and a peripheral surface.

a drum is disposed with its axis approximately horizontal, and a raw material supply portion is formed at said large diameter end.

9. The fine powder heat treating apparatus according to claim 8, wherein a drum body for cooling is connected to the small diameter end of said drum.

10. The fine powder heat treating apparatus according to claim 8, wherein a corner portion between said peripheral surface and an end surface on the side of the large diameter end is a curved surface, and each of said rolling media is spherical in shape.

11. The fine powder heat treating apparatus according to claim 10, wherein the radius of curvature of said corner portion is larger than the radius of each of the rolling media.

12. The fine powder heat treating apparatus according to claim 8, wherein a member for preventing rolling media from jumping out of the drum body, having an opening through which said rolling medium cannot pass, is disposed at the small diameter end of said drum body.

13. The fine powder heat treating apparatus according to claim 12, wherein said member for preventing rolling media from jumping out has a plate-shaped member having a plurality of slits serving as said opening formed therein and a supporting member for mounting the plate-shaped member on the drum.

14. The fine powder heat treating apparatus according to claim 12, wherein said member for preventing rolling media from jumping out has an inner cylinder and an outer cylinder which are concentrically disposed and connected to each other, and said opening is formed in a clearance between the inner cylinder and the outer cylinder.

15. The fine powder heat treating apparatus according to claim 8, further comprising a housing surrounding said drum body, said heating means being provided in the housing.

16. The fine powder heat treating apparatus according to claim 8, further comprising a housing surrounding said drum body, said heating means being provided outside the housing.

17. The fine powder heat treating apparatus according to claim 8, wherein the axis of the drum body is so inclined that the end of the axis at the large diameter end of said drum body is in a position higher than the end of the axis at the small diameter end thereof.

18. The fine powder heat treating apparatus according to claim 8, wherein said rolling media are made of a material selected from the group consisting of ceramics and refractory materials.

19. A method of fabricating heat-treated fine powder in which a ceramic slurry containing fine ceramic powder and a liquid component is subjected to a heat treatment operation, to obtain a fine powdered material, comprising the steps of:

supplying said ceramic slurry to a container containing rolling media; and heating said rolling media and said container to a temperature sufficient to vaporize the liquid component and to heat-treat the fine ceramic powder, while said ceramic slurry and said rolling media are being mixed with each other.

* * * * *